United States Patent [19]

Cooley et al.

[11] 3,930,435

[45] Jan. 6, 1976

[54] HYDRAULICALLY POWERED ACTUATOR

[76] Inventors: William C. Cooley, 5400 Pooks Hill Road, Bethesda, Md. 20014; Franklin L. Beck, 3840 39th St., N.W., Washington, D.C. 20016

[22] Filed: May 25, 1973

[21] Appl. No.: 363,878

[52] U.S. Cl. ..... 91/39; 91/189; 91/217; 92/134

[51] Int. Cl.[2] ..... F01B 15/02; F15B 21/02

[58] Field of Search ..... 91/47, 48, 50, 217, 216 R, 91/216 B, 39; 92/146, 151, 152

[56] References Cited

UNITED STATES PATENTS

| | | | |
|---|---|---|---|
| 526,342 | 9/1894 | Carlinet | 91/217 |
| 2,831,464 | 4/1958 | Lillquist | 91/217 |
| 3,456,744 | 7/1969 | Altschuler | 91/217 |
| 3,732,784 | 5/1973 | Vogelci et al. | 91/217 |

*Primary Examiner*—Paul E. Maslousky
*Attorney, Agent, or Firm*—Edwin E. Greigg

[57] ABSTRACT

What follows is a description of a hydraulically powered actuator for producing a reciprocating output and a method which produces a reciprocating output in response to the controlled flow of a hydraulic fluid. The hydraulic actuator includes, in one embodiment, a cylinder within which a piston assembly is reciprocated, the cylinder being itself displaceably mounted within a housing so that it can periodically introduce a unique flow passage through which a rapid fluid flow occurs, the provision of the passage reduces the hydraulic power lost during reciprocating movement of the piston assembly and ensures a high energy output.

9 Claims, 3 Drawing Figures

HYDRAULICALLY POWERED ACTUATOR

CROSS REFERENCE TO RELATED APPLICATION

The present application discloses subject matter common to applicants' concurrently filed copending application, Ser. No. 363,879, entitled "MECHANICALLY ACTUATED HAMMER AND BIT ASSEMBLY THEREFOR."

BACKGROUND OF THE INVENTION

1. Field of the Invention

The present invention relates to hydraulically powered actuators, and more particularly to hydraulically powered actuators which produce a reciprocating high energy output, and to a method of producing a reciprocating energy output for hydraulically powered acutators.

2. Description of the Prior Art

Actuators of the general type under consideration are disclosed, for example, in U.S. Pat. No. 3,412,554 issued on Nov. 26, 1968 to B. V. Voitsekhovsky et al, and re-issued as U.S. Pat. No. Re. 27,244 on Dec. 14, 1971, U.S. Pat. No. 3,593,524 issued on July 20, 1971 to G. P. Chermensky et al, U.S. Pat. No. 3,601,987 issued on Aug. 31, 1971 to G. P. Chermensky et al, and U.S. Pat. No. 3,601,988 issued on Aug. 31, 1971 to G. P. Chermensky et al. The devices disclosed in these patents are limited in their efficiency, inter alia, by the fact that liquid is throttled through narrow radial ports which causes the moving ram element of these actuators to be subjected to excessive liquid drag.

OBJECTS AND SUMMARY OF THE INVENTION

It is, therefore, a general object of the present invention to provide a hydraulically powered actuator which overcomes the stated disadvantages of the known art.

It is a more specific object of the present invention to provide a hydraulically powered actuator which is simple in construction and reliable in operation with less hydraulic resistance to motion of its ram element so that it can operate at higher efficiencies.

It is a related object of the present invention to provide a hydraulically powered actuator in which high output energies are achieved by a unique method and structure to permit decreased hydraulic resistance to motion of the ram element.

It is a more specific object of the present invention to provide a hydraulically powered actuator which has a displaceable member capable of periodically introducing a unique flow passage which aids in effecting a reciprocating movement of a piston assembly of the actuator thereby ensuring a high energy output.

These and other objects are accomplished according to one embodiment of the present invention by the provision of a hydraulically powered actuator which includes a piston assembly and a cylinder within which the piston assembly is reciprocated. The cylinder is itself displaceably mounted in order to provide a large passage for liquid to escape during firing of the piston assembly. The result is a high energy reciprocating output.

According to one method of the present invention, the cylinder is moved in a direction toward a closed position so that the piston assembly can be moved in a second direction toward a cocked position. Thereafter, the cylinder is moved in a second direction toward an open position, which establishes the large passage, and then the piston assembly is fired and caused to move in the first direction. This procedure is followed repeatedly as often as desired in order to produce the high energy reciprocating output.

DESCRIPTION OF THE PREFERRED EMBODIMENTS

Figure 1:
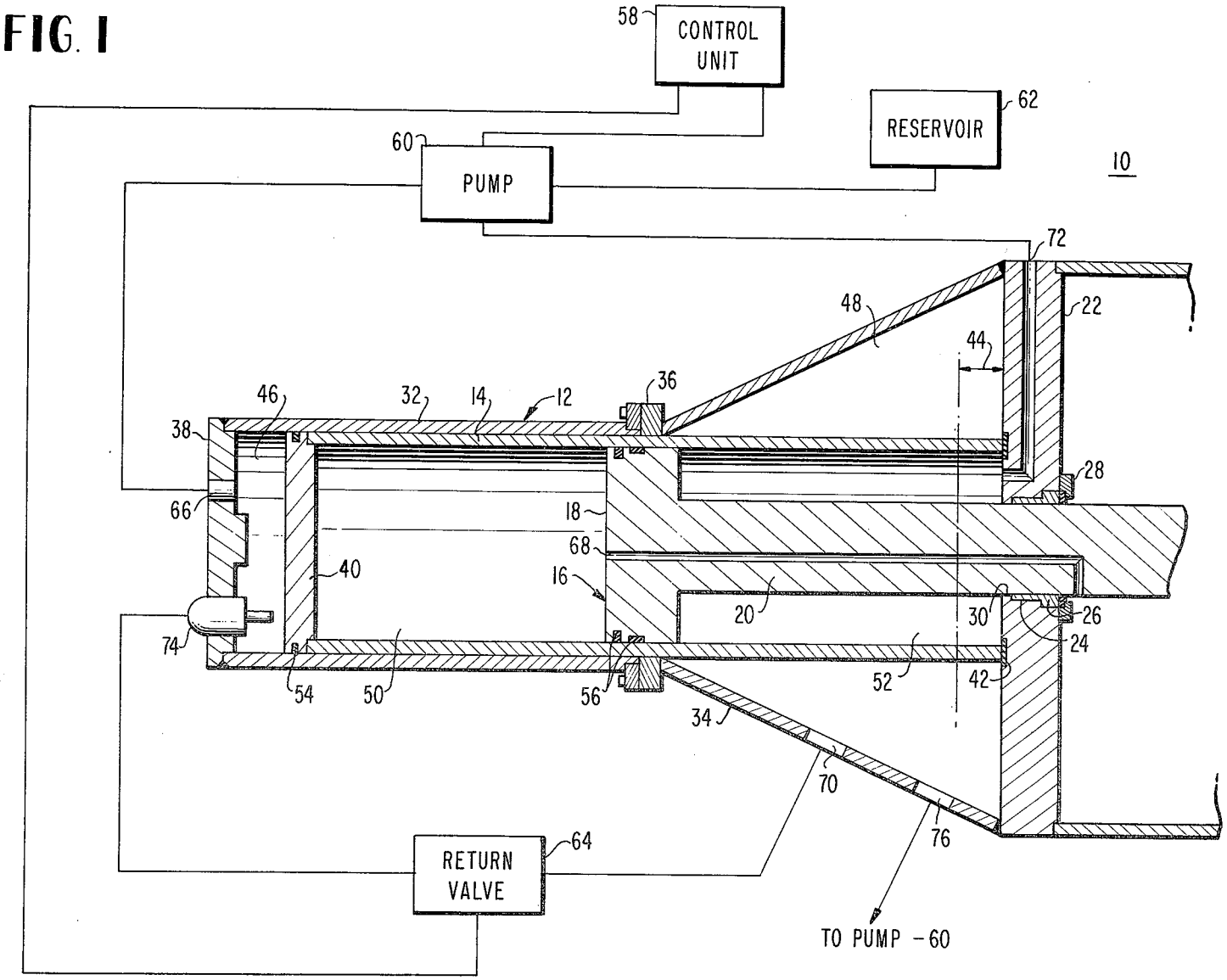
FIG. 1 is a schematic view in cross section illustrating the hydraulically powered actuator according to the present invention and one embodiment of its associated control circuit.
Figure 2:
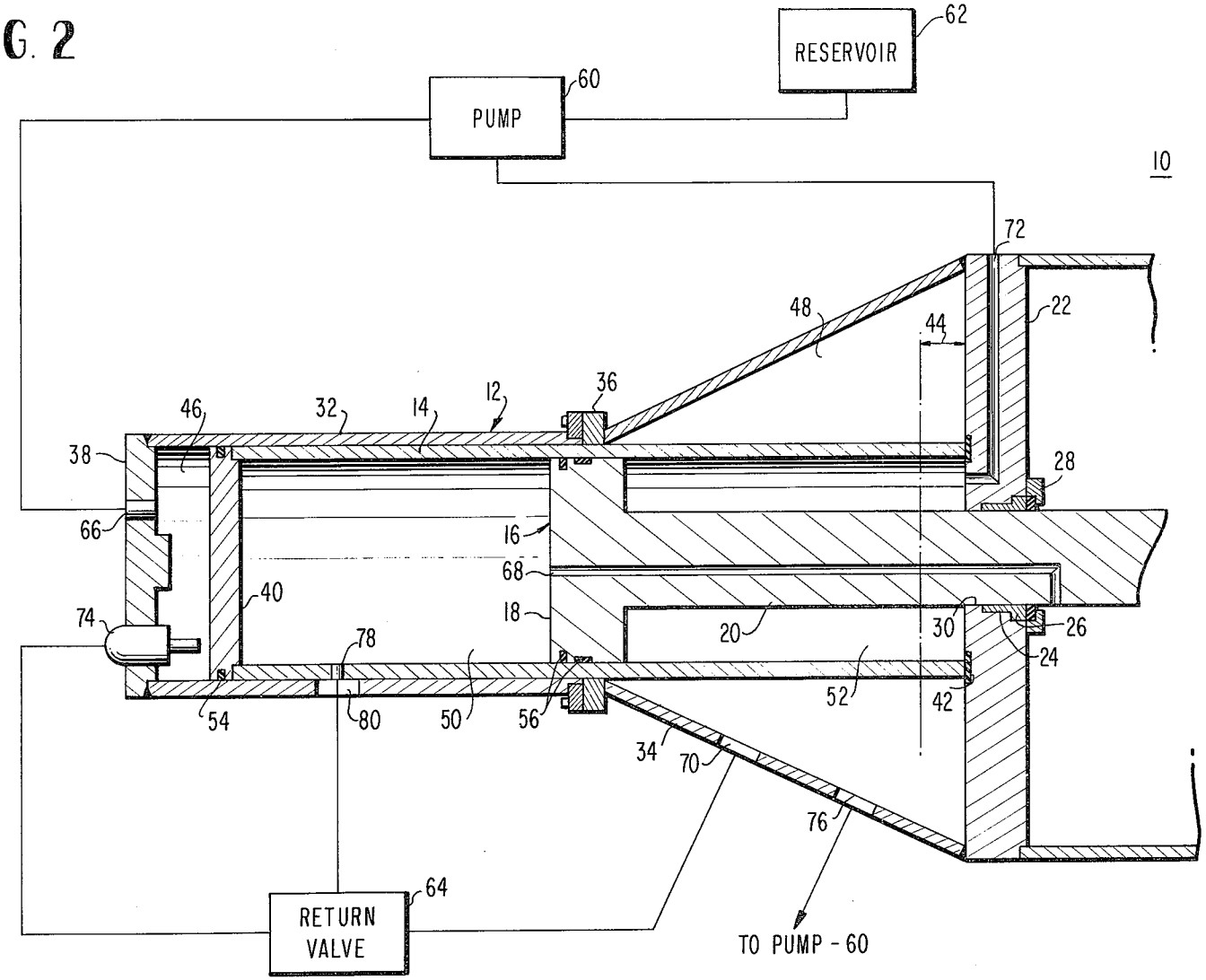
FIG. 2 is a schematic view like FIG. 1, illustrating an alternate embodiment of the associated control circuit for the hydraulically powered actuator.
Figure 3:
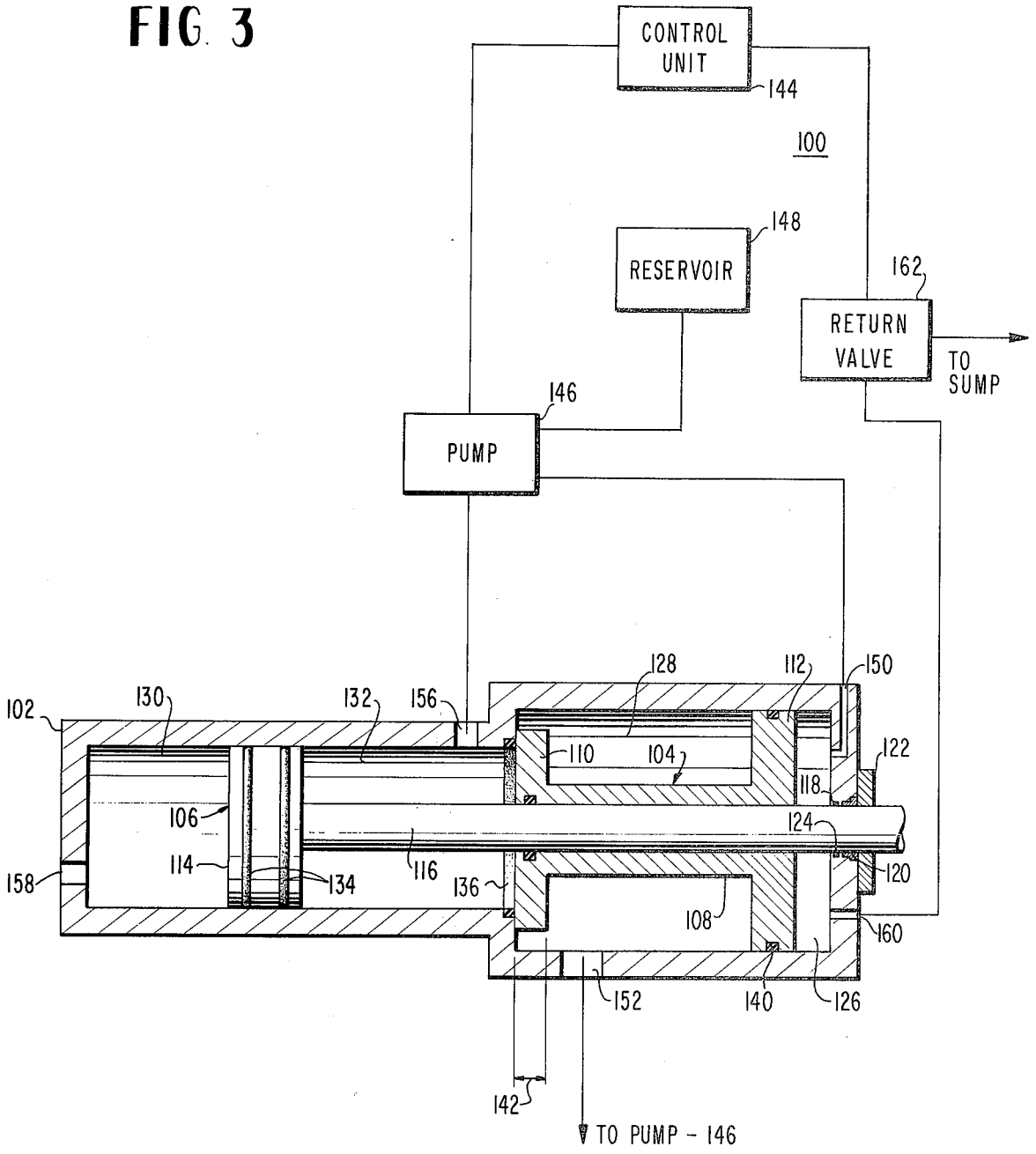
FIG. 3 is a schematic view in cross section illustrating an alternate embodiment of the hydraulically powered actuator according to the present invention.

Turning now to a more detailed consideration of the present invention as illustrated in the exemplary embodiments of FIGS. 1 – 3, there is shown a hydraulic actuator which produces a high energy reciprocating output and which may be used with a percussion bit assembly (not shown) to form a hydraulic hammer.

Referring first to FIG. 1, there is illustrated a hydraulic actuator 10 including a housing member 12 within which a working cylinder 14 is displaceably mounted. Mounted within the working cylinder 14 for reciprocating movement is a piston assembly 16. The piston assembly 16 includes a piston 18 and a piston rod 20 which extends through a transverse end plate 22 of the housing member 12. The housing member 12 is connected to the transverse end plate 22 in any conventional manner, such as, for example, by welding. The piston rod 20 extends through a bore 24 formed centrally within the end plate 22. Preferably the bore is lined with a bushing 26 which is retained within the bore 24 by an externally fastened retaining ring 28. At the opposite end of the bore 24 adjacent to the bushing 26 there is provided a fluid seal 30. The external end of the piston rod 20 can either form the ball of a ball-and-socket joint or it can terminate in an adapter block (not shown) for connecting the actuator 10 to, for example, a percussion bit to form a hydraulic hammer. In this way, the reciprocating output of the actuator 10 is transmitted to the percussion bit.

The housing member 12 is preferably formed to include an upper portion 32 and a lower portion 34. The two portions may be joined together by, for example, a plurality of circumferentially arranged bolted joints 36. Alternatively, the lower portion 34 may be formed integrally with the upper portion 32 if so desired. The free end of the upper portion 32 is closed by a transverse head plate 38.

The working cylinder 14 is closed at one end by a transverse end plate 40 and retained opened at its opposite end. The open end of the working cylinder 14 engages a face seal 42 located within the inner transverse surface of the end plate 22. The free end of the working cylinder 14, when displaced within the housing member 12 away from the face seal 42, defines an annular passage 44. The importance of the passage 44 will be described hereinafter.

The assembled members of the actuator described above form a number of working chambers, which, for convenience, will be identified as the first, second, and third working chambers, and a sump. The first working chamber 46 is defined by the upper portion 32 of the housing member 12, the transverse head plate 38 and the transverse end plate 40. The 48 is defined by the lower portion 34 of the housing member 12, the working cylinder 14 and the transverse end plate 22. The second working chamber 50 is defined by the working cylinder 14, the transverse end plate 40 and the piston 18. Finally, the third working chamber 52 is defined by the working cylinder 14, the piston 18, the piston rod 20 and the transverse end plate 22. As can be seen, the annular passage 44 provides access between the sump 48 and third working chamber 52.

The transverse end plate 40, as well as the piston 18, is provided with appropriate seals 54 and 56, respectively, to ensure a sufficient pressure seal between the first working chamber 46 and the sump 48, and between the second and third working chambers 50 and 52.

To provide a high energy reciprocating output through the piston rod 20, it is desirable according to the present invention to provide rapid escape of the piston cocking fluid during piston firing. To accomplish this purpose, it is proposed according to the present invention to provide a large annular passage in the form of the passage 44. With such a design it has been found that a reciprocating output energy level in excess of 3000 FT-LBS is possible. It is only necessary to displace the working cylinder 14 from the face seal 42 at an appropriate time in the cycle of operation of the piston assembly 16.

To accomplish this purpose, the following control circuit is employed. A control unit 58 sequentially controls the operation of a pump 60, and a return valve 64. The pump 60 is connected to the first working chamber 46, the sump 48, the third working chamber 52, and to a reservoir 62. Ports 66, 72 and 76 in the transverse head plate 38, in the end plate 22, and in the lower portion 34 of the housing member 12, respectively, are provided for this purpose. Finally, the return valve 64 is connected between the first working chamber 46 and the sump 48. Ports 74 and 70 in the transverse head plate 38 and in the lower portion 34 of the housing member 12 are provided for this purpose. According to the present invention the second working chamber 50 is supplied with compressed gas through a conventional gas fill port 68 provided in the piston assembly.

MODE OF OPERATION

The actuator 10 operates as follows: after pressurizing the second working chamber 50 through the gas fill port 68 in the piston assembly 16, pump 60 is actuated and delivers pressurized liquid from the reservoir 62 to the first working chamber 46 through the port 66. Charging of the first working chamber 46 causes the working cylinder 14 to move in a first direction and seat itself against the face seal 42. Thereafter, the pump 60 is caused to deliver pressurized liquid from the reservoir 62 through the port 72 to the third working chamber 52. Charging of the third working chamber 52 results in moving the piston assembly 16 in a second direction (cocking of the piston assembly), which in turn results in further compressing the gas within the second working chamber 50. After the piston assembly 16 is cocked, the return valve 64 is opened by the control unit 58 permitting a rapid bleed-off from the first working chamber 46 through the port 74 and into the sump 48 through the port 70. As a result of the bleed-off, the working cylinder 14 is rapidly moved away from the face seal 42 in the second direction and defines an annular passage 44 which provides access between the third working chamber 52 and the sump 48. The pressurized gas in the second working chamber 50 then fires the piston assembly 16 (piston assembly moves in the first direction) thereby producing a working stroke of the actuator 10, for actuating, for example, a percussion bit of a hydraulic hammer. Because of the large annular passage 44, the pressurized liquid within the third working chamber 52 is provided with a means for rapidly escaping into the sump 48 and from there through the port 76 to the reservoir 62 under the influence of the pump 60. Thereafter, the first working chamber 46 is once again charged by the pump 60 causing the working cylinder 14 to be seated against the face seal 42, and the cycle repeated. It should be noted that the working chamber 46 is subsequently charged preferably near the end of the stroke of the piston assembly 16 to effect dampening of the piston stroke.

Because of the principle of a movable working cylinder according to the present invention, it is possible to realize higher energy outputs than has been known heretofore.

Turning now to FIG. 2, there is illustrated an alternative embodiment of the control circuit for effecting operation of the actuator 10. According to this embodiment, a control sensor 78 is mounted in the wall of the working cylinder 14 and is connected to the return valve 64. A slot 80 in the upper portion 32 of the housing member 12 is provided to allow for the movement of the working cylinder 14. At a predetermined point in the cocking of the piston assembly 16, the piston 18 coacts with the control sensor 78 to actuate the return valve 64. Actuation of the return valve 64 causes a rapid bleed-off from the first working chamber 46 with an effect described above. The operation of the pump 60 is similar to that described above. Because of the control sensor 78 it is possible to dispense with the control unit 58 and provide continuous operation of the pump 60 without adversely affecting the high energy output of the actuator 10.

Turning now to FIG. 3, there is illustrated an alternative embodiment of the actuator according to the present invention. The actuator 100 includes a housing member 102 within which a servo valve 104 and a piston assembly 106 are displaceably mounted as shown. The servo valve 104 is configured to include a body portion 108 and end flanges 110 and 112. The end flanges 110 and 112 serve as pistons in a manner to be described hereinafter. The piston assembly 106 includes a piston 114 fixed to one end of a piston rod 116. The piston rod 116 extends through a bore 118 of the housing member 102. Preferably the bore 118 is lined with a bushing 120 which is retained within the bore 118 by an externally fastened retaining ring 122. At the opposite end of the bore 118 adjacent to the bushing 120 there is provided a fluid seal 124. The external end of the piston rod 116 can either form the ball of a ball-and-socket joint or it can terminate in an adapter block (not shown) for connecting the actuator 100 to, for example, a percussion bit to form a hydraulic hammer. In this way, the reciprocating output of the actuator 100 is transmitted to the percussion bit.

The housing member 102, the servo valve 104 and the piston assembly 106 form a number of working chambers to be identified as the first, second, third and fourth working chambers. The first working chamber 126 is defined by the housing 102, the flange 112 and the piston rod 116. The second working chamber 128 is defined by the housing 102, the body portion 108, and the flanges 110 and 112. The third working chamber 130 is defined by the housing 102 and the piston 114. The fourth working chamber 132 is defined by the housing 102, the piston 114, the piston rod 116 and the flange 110.

Appropriate seals 134, 136, 138 and 140 are provided to ensure a sufficient pressure seal between the various working chambers as can be clearly seen. The seal 136 is a face seal similar to seal 42 of the embodiment of FIGS. 1 and 2.

The purpose in this embodiment is similar to the embodiment of FIGS. 1 and 2, namely, to provide a large annular passage in the form of a passage 142. According to this embodiment, it is only necessary to displace the flange 110 from the face seal 136 at an appropriate time in the cycle of operation of the piston assembly 106.

In this case, the control circuit includes a control unit 144, a pump 146, a return valve 162 and a reservoir 148. The pump 146 is connected to the first, second and fourth working chambers 126, 128 and 132. Ports 150, 152 and 156 in the housing member 102 are provided for this purpose, and the return valve 162 is connected through a port 160 to the first working chamber 126 and to a sump (not shown).

MODE OF OPERATION

The actuator 100 operates as follows: first the third working chamber 130 is charged through port 158 with, for example, high pressure nitrogen. It should be noted that the chamber 130 is only charged periodically and not for each cycle of operation of the piston assembly 106. With a charged chamber 130, the control unit 144 causes the pump 146 to be actuated and to thereby deliver pressurized liquid from the reservoir 148 through the port 150 to the first working chamber 126. The pressure exerted against the piston flange 112 causes the servo valve 104 to move in a first direction toward the left until the flange 110 seats itself against the face seal 136. Thereafter, the pump 146 causes pressurized liquid to be delivered from the reservoir 148 through the port 156 to the fourth working chamber 132. Charging of the fourth working chamber 132 results in moving of the piston assembly 106 also in the first direction (cocking of the piston assembly), which in turn results in a compression of the gas within the third working chamber 130. After the piston assembly 106 is cocked, the control unit actuates the return valve 162 causing the pressurized liquid in the first working chamber 126 to be dumped through the port 160 and the return valve 162 into a sump (not shown), and thereafter to the reservoir 148. As a result, the servo valve 104 is moved in a second direction toward the right away from the face seal 136 to define thereby the annular passage 142. The annular passage 142 provides access between the fourth working chamber 132 and the second working chamber 128. The pressurized gas in the third working chamber 130 then fires the piston assembly 106 (piston assembly moves in the second direction), thereby producing a working stroke of the actuator 100. Because of the relatively large annular passage 142, the pressurized liquid within the fourth working chamber 132 is provided with a means for rapidly escaping into the second working chamber 128 and from there through the port 152 to the reservoir 148 under the influence of the pump 146. The cycle is thereafter repeated at will similarly to the embodiment of FIGS. 1 and 2.

What is claimed is:

1. A hydraulically powered actuator for producing a reciprocating output, comprising in combination:

a. a housing member including an upper and lower portion with a head plate extending transversely across an open extremity of said upper portion and an end plate extending transversely across an open extremity of said lower portion;

b. a cylinder displaceably mounted within said housing member, said cylinder being open ended at one extremity and closed by a transverse end plate at the other extremity;

c. a piston assembly slidably mounted through said housing member for reciprocal movement within said cylinder, said piston assembly including a piston and a piston rod, said piston rod being slidably mounted through the end plate of said housing member to extend outwardly therefrom to thereby serve as the reciprocating output;

d. first means effecting movement of said cylinder in a first direction relative to said housing member and said piston assembly;

e. second means effecting movement of said piston assembly in a second direction relative to said cylinder and said housing member;

f. third means effecting movement of said cylinder and said piston assembly relative to each other and to said housing member so that said cylinder moves in the second direction and said piston assembly moves in the first direction; and g. control means for sequentially controlling the respective operation of said first, second and third means for effecting the reciprocating output, wherein said cylinder end plate, said head plate and said upper portion define a first working chamber, and said housing member end plate, said lower portion and said cylinder define a fluid working chamber.

2. The hydraulically powered actuator as defined in claim 1, wherein said upper and lower portions are separate members, and wherein said actuator further comprises connecting means for connecting said separate upper and lower portions to form said housing member with open extremities which are closed by said head plate and said lower portion end plate.

3. The hydraulically powered actuator as defined in claim 1, wherein said upper portion is cylindrical and said lower portion is frusto-conical.

4. The hydraulically powered actuator as defined in claim 1, wherein said head plate is provided with first and second connecting means, with said first connecting means connecting said first means to said first working chamber, and said second connecting means connecting said third means to said first working chamber.

5. The hydraulically powered actuator as defined in claim 1, wherein said lower portion is provided with third connecting means connecting said third means to said fluid sump.

6. The hydraulically powered actuator as defined in claim 1, wherein said cylinder, said cylinder end plate and said piston define a second working chamber, and wherein said piston, said piston rod, said cylinder and said lower portion end plate define a third working chamber.

7. The hydraulically powered actuator as defined in claim 6, wherein said piston assembly includes means through which said second chamber is charged.

8. The hydraulically powered actuator as defined in claim 6, wherein said lower portion end plate is provided with a through bore, a face seal and fourth connecting means, and wherein said piston rod extends through said through bore and outwardly from said lower portion, said open ended extremity of said cylinder is engageable with said face seal, and said fourth connecting means connects said second means to said third working chamber.

9. The hydraulically powered actuator as defined in claim 8, wherein said open ended extremity of said cylinder and said face seal define a variable opening passage between said fluid sump and said third working chamber.

* * * * *